US006213559B1

(12) United States Patent
Stevens

(10) Patent No.: US 6,213,559 B1
(45) Date of Patent: Apr. 10, 2001

(54) SCARIFYING BLADE WITH ROTATABLE BITS

(76) Inventor: Robert J. Stevens, P.O. Box 592, Saratoga, WY (US) 82331

( * ) Notice: Subject to any disclaimer, the term of this patent is extended or adjusted under 35 U.S.C. 154(b) by 0 days.

(21) Appl. No.: 09/426,223

(22) Filed: Oct. 22, 1999

Related U.S. Application Data

(60) Provisional application No. 60/114,561, filed on Dec. 31, 1998.

(51) Int. Cl.[7] ..... E01C 23/12

(52) U.S. Cl. ..... 299/36.1; 404/90; 37/448; 37/450; 172/782

(58) Field of Search ..... 299/36.1; 404/75, 404/90; 37/448, 446, 450, 454, 465, 398, 219; 172/781, 782, 811

(56) References Cited

U.S. PATENT DOCUMENTS 2,727,319 * 12/1955 Evans ..... 37/450
4,784,517 * 11/1988 Bergqvist et al. ..... 404/75

* cited by examiner

*Primary Examiner*—David Bagnell
*Assistant Examiner*—Sunil Singh
(74) *Attorney, Agent, or Firm*—Dean P. Edmundson

(57) ABSTRACT

A scarifying blade for use on earthmoving equipment (e.g. a road grader). The lower working edge of the blade has attached to it several spaced rotatable bits, and attached to at least one of the ends of the blade is an end rotatable bit at an angle of about 30 to 60 degrees relative to the spaced bits on the lower edge of the blade. The end bits prevent loosened material from spilling around the end of the blade and they also provide other additional advantages.

3 Claims, 5 Drawing Sheets

SCARIFYING BLADE WITH ROTATABLE BITS

CROSS-REFERENCE TO RELATED APPLICATION

This application is based upon, and claims the benefit of, my provisional Application Ser. No. 60/114,561, filed Dec. 31, 1998.

FIELD OF THE INVENTION

This invention relates to scarifying blades which are used on road graders or earth moving equipment. More particularly, this invention relates to improvements to the ends of scarifying blades.

BACKGROUND OF THE INVENTION

Road graders are commonly used to grade existing dirt and gravel roads by moving an angled blade along the road in contact with the surface of the road. The blade smooths out the high and low spots in the road. Road graders are also used to cut in new roads.

An improved type of blade, known as a scarifying blade, includes a plurality of rotatable carbide bits along the working edge of the blade. These bits are able to penetrate and fracture hard-packed road surfaces.

One problem that has been observed with the use of existing scarifying blades is that dirt and gravel tend to build up in front of the blade and then spill outwardly around and behind the leading end of the blade. This is a serious disadvantage when using the blade for creating ditches or when trying to pull gravel from areas close to the shoulder of a road. Also, the pockets holding the bits near the end of the blade tend to wear out.

U.S. Pat. No. 4,055,223 describes a corner tooth assembly for an earth moving implement. U.S. Pat. No. 4,883,129 describes a bit assembly having a carbide insert. U.S. Pat. No. 2,840,934 describes a removable tooth for mounting on a blade. U.S. Pat. Nos. 4,047,312 and 3,638,736 describe a corner tooth assembly for earth moving equipment or dozer blade. U.S. Pat. Nos. 2,965,989, 3,289,331, 3,456,370 and 3,465,833 describe end bits for dozer blades. U.S. Pat. No. 2,831,275 describes a reversible bit for a scraper bowl edge. U.S. Pat. No. 5,377,766 describes an angled blade attachment for a loader bucket. U.S. Pat. No. 4,741,116 describes a wing assembly for a snowplow. U.S. Pat. No. 4,753,299 describes a grader blade having a plurality of spaced picks located in sockets along the lower edge of the support frame.

There has not heretofore been provided a scarifying blade having the features and advantages provided by the present invention.

SUMMARY OF THE INVENTION

In accordance with the present invention there is provided an improved scarifying blade for use on earthmoving equipment and having a lower working edge, two ends, and a plurality of spaced bits attached to the working edge. Attached to at least one end (and preferably to both ends) there is a rotatable end bit having a longitudinal axis which forms an angle in the range of about 30 to 60 degrees relative to the longitudinal axis of the spaced bits. Preferably, there is also a generally vertical plate extending upwardly from each end bit. The plate forms an angle with the spaced bits which is the same as the angle between the end bit and the spaced bits. This would be the same angle as that formed between the plate and a line which is perpendicular to the front of the blade.

With the angled end bit on the blade, the blade is very useful in situations where it is necessary to create ditches or move gravel from road shoulders. The angled end bit is effective in loosening dirt, gravel, rocks, etc. and directing the loosened material toward the front of the blade instead of letting it fall outwardly around the end of the blade. The angled end bit also protects the end of the blade from excessive wear.

Other features and advantages of the improved blade of this invention will be apparent from the following detailed description and the accompanying drawings.

BRIEF DESCRIPTION OF THE DRAWINGS

The invention is described in more detail hereafter with reference to the accompanying drawings, wherein like reference characters refer to the same parts throughout the several views and in which.

DETAILED DESCRIPTION OF THE INVENTION

Figure 1:
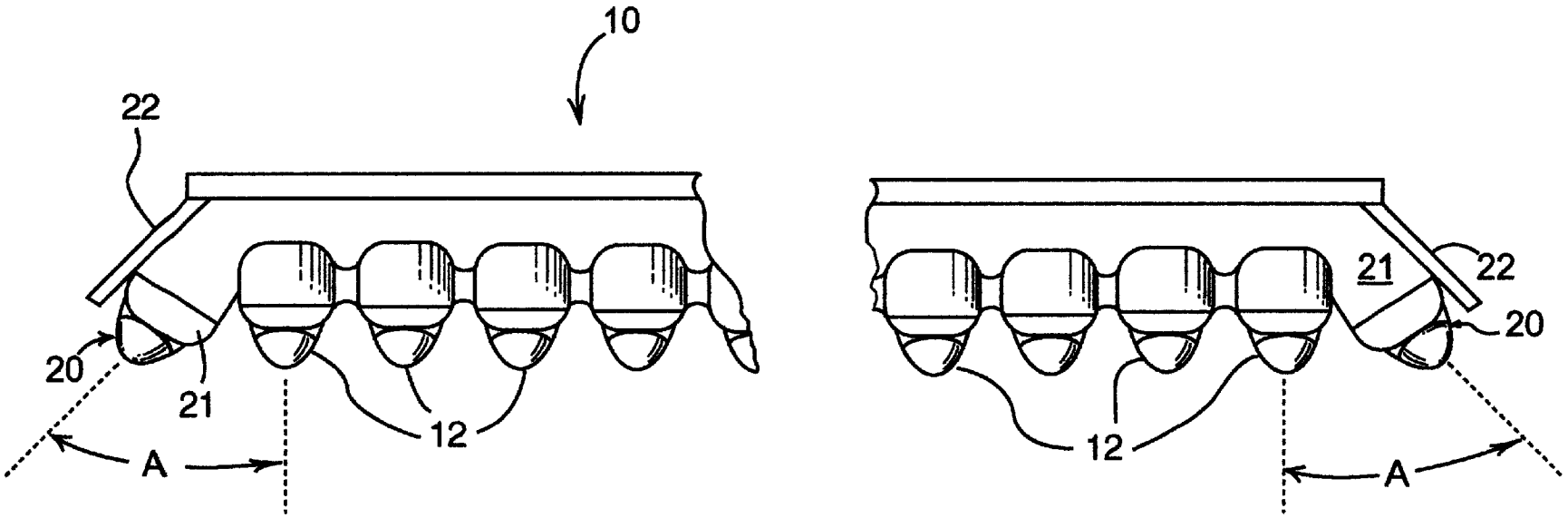
FIG. 1 is a top view of a preferred embodiment of a scarifying blade of the invention.
Figure 2:
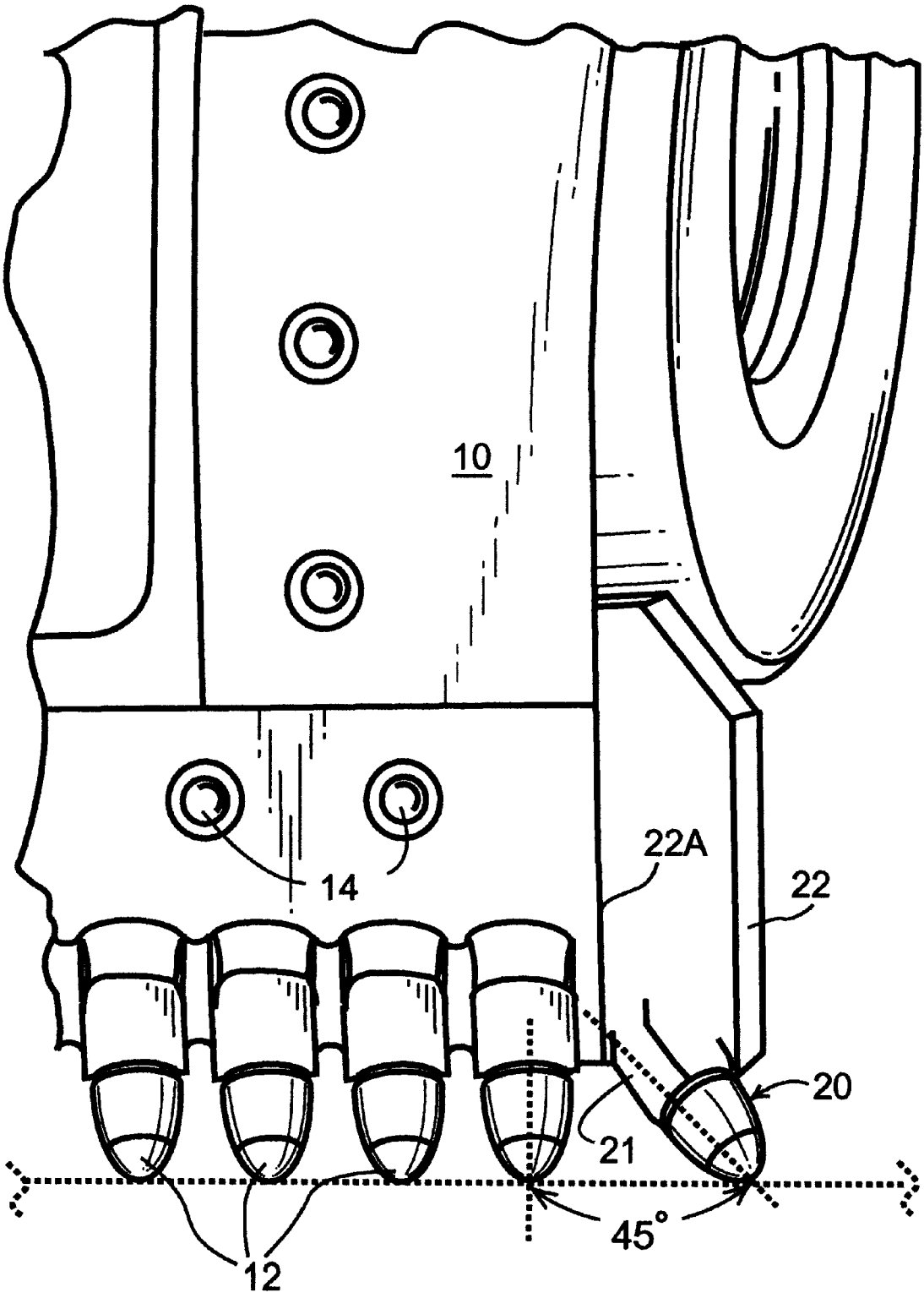
FIG. 2 is a front view of the blade of FIG. 1.
Figure 3:
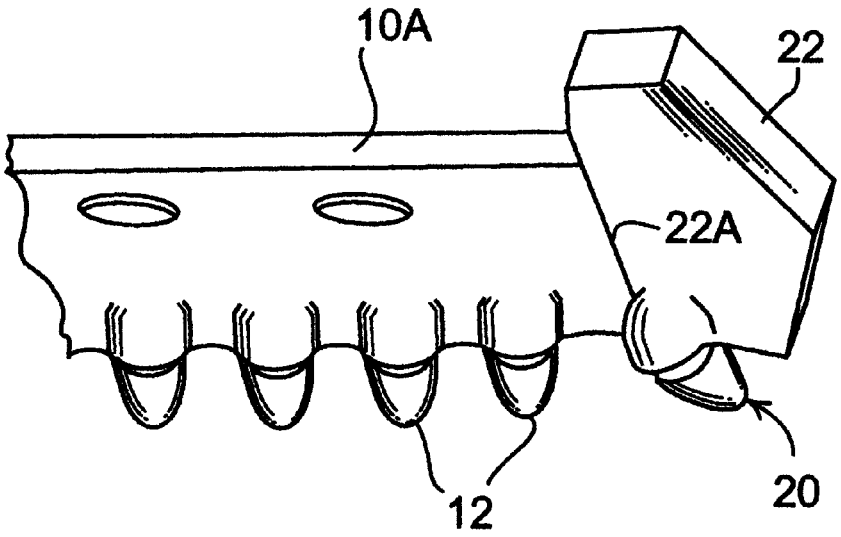
FIG. 3 is a front view of one embodiment of a bolt-on end section for a scarifying blade.
Figure 4:
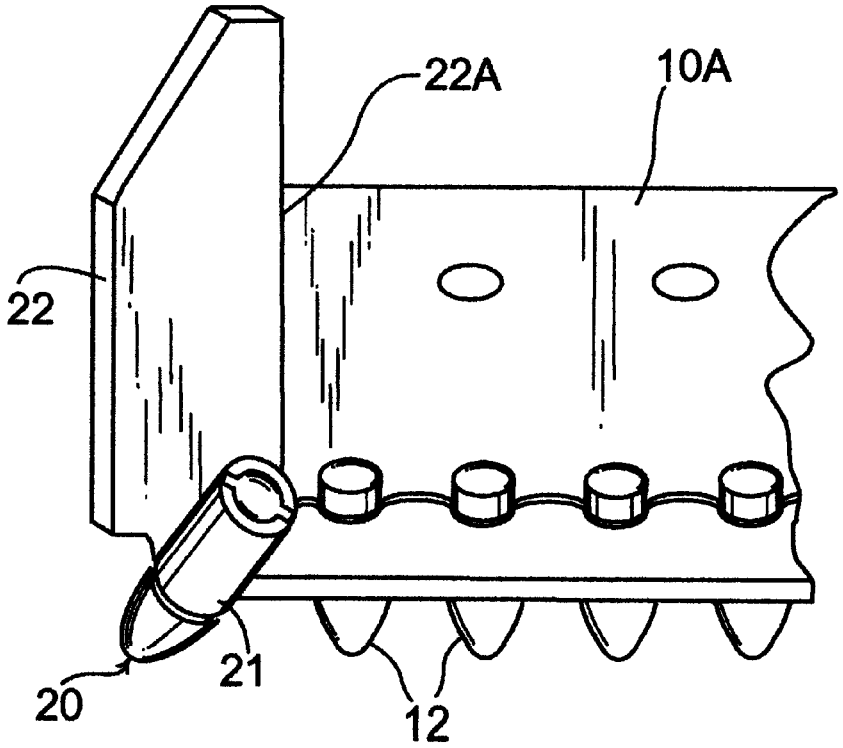
FIG. 4 is a rear elevational view of the end section shown in FIG. 3.
Figure 5:
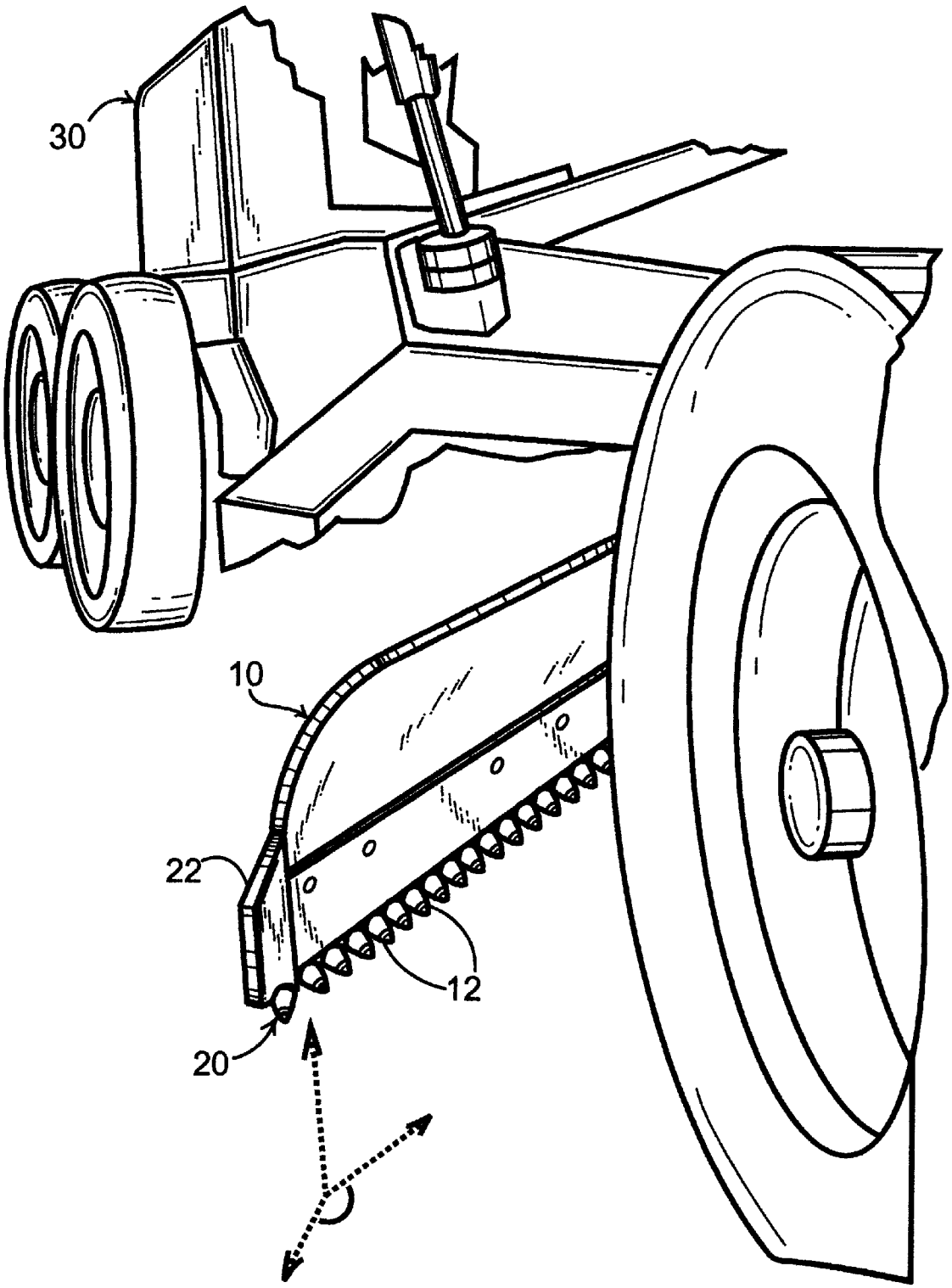
FIG. 5 is a perspective view showing a road grader with an improved scarifying blade of the invention.
Figure 6:
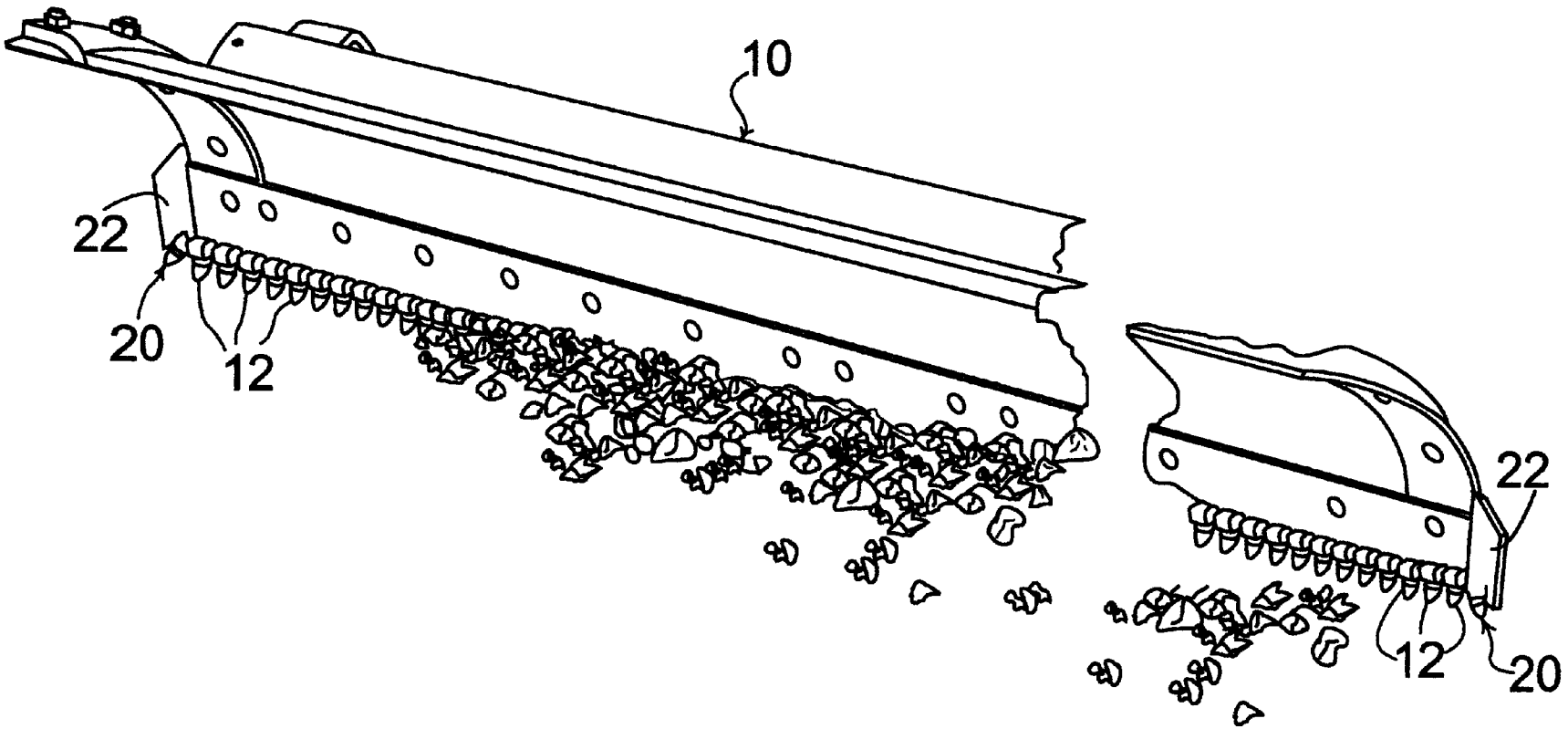
FIG. 6 is an isometric view of a scarifying blade of the invention.

In the drawings there is shown an improved scarifying blade 10 for use on a road grader 30. Along the lower working edge of the blade there are attached a plurality of rotatable carbide bits 12 which preferably are mounted in sockets such that any bit can be easily removed and replaced when necessary. These bits are spaced reasonably close to each other and form a downward angle of about 37 degrees relative to the lower edge of the blade.

The end bits 20 are also rotatable carbide bits each of which is rotatably mounted in a socket 21 which enables a bit to be removed and replaced when necessary. The angle A between the longitudinal axis of each end bit and the conventional spaced bits 12 on the lower edge of the blade is in the range of about 30 to 60 degrees (preferably about 45 degrees).

Extending upwardly from the end bit 20 is a plate member 22 which preferably is welded along its bottom edge to the socket 21 holding rotatable bit 20. One side edge 22A of the plate is welded or attached to the end of the blade 10. The plate thus is angled forwardly and outwardly relative to the front surface of the blade. The angle between the plate and the longitudinal axis of the spaced bits 12 is generally the same as the angle between the end bit and bits 12. The height of the blade may vary but it is generally is several inches in height. The width of the plate is about 3–4 inches.

As shown in the drawings, the lower working edge of the blade may comprise several individual sections which are bolted to the main body of the blade (e.g. with bolts 14).

As another alternative, an end bit of the type which is described in this application may be simply welded to one or both ends of a conventional scarifying blade at an angle of about 30 to 60 degrees so as to make the end bit an integral part of the blade.

Other variants are possible without departing from the scope of this invention.

What is claimed is:

1. A scarifying blade for use on a road grader and having a lower working edge, two ends, and a plurality of spaced bits attached to said working edge; wherein there is attached to at least one of said ends a rotatable end bit having a longitudinal axis which forms an angle in the range of about 30 to 60 degrees relative to the longitudinal axis of said spaced bits; wherein said spaced bits are mounted in sockets which enable said bits to rotate; and further comprising a plate member extending upwardly from said end bit and forming an angle of about 30 to 60 degrees relative to the axis of the spaced bits.

2. A blade in accordance with claim 1, wherein a rotatable end bit is attached to each end of said blade.

3. A blade in accordance with claim 1, wherein said longitudinal axis of said rotatable end bit forms an angle of about 45 degrees relative to the longitudinal axis of said spaced bits.

* * * * *